US005259755A

United States Patent [19]

Irwin et al.

[11] Patent Number: 5,259,755

[45] Date of Patent: Nov. 9, 1993

[54] COMBINATION BURNER WITH BOOST GAS INJECTION

[75] Inventors: Bruce C. Irwin, Palmyra; Edward E. Moore, Hummelstown; Raymond F. Baum, Lebanon, all of Pa.

[73] Assignee: Hauck Manufacturing Company, Lebanon, Pa.

[21] Appl. No.: 922,765

[22] Filed: Jul. 31, 1992

[51] Int. Cl.[5] ..... F23C 17/00; F23C 9/00; F23C 5/06

[52] U.S. Cl. ..... 431/9; 431/182; 431/188; 431/284; 431/285; 431/189

[58] Field of Search ..... 431/285, 286, 182, 8, 431/181, 187, 279, 284, 188, 189, 9

[56] References Cited

U.S. PATENT DOCUMENTS

| | | | |
|---|---|---|---|
| 2,222,822 | 11/1940 | Nordensson | 431/285 |
| 2,439,554 | 4/1948 | Anderson | 431/184 |
| 3,163,203 | 12/1964 | Ihlenfield . | |
| 3,217,779 | 11/1965 | Reed et al. . | |
| 3,391,981 | 7/1968 | Voorheis et al. . | |
| 3,897,200 | 7/1975 | Childree | 431/285 X |
| 4,298,337 | 11/1981 | Butler et al. . | |
| 4,441,879 | 4/1984 | Wagner et al. . | |
| 4,451,230 | 5/1984 | Bocci et al. . | |
| 4,559,009 | 12/1985 | Marino et al. | 431/184 |
| 4,717,332 | 1/1988 | Edens . | |
| 4,859,173 | 8/1989 | Davis, Jr. et al. . | |
| 5,009,174 | 4/1991 | Polak . | |

FOREIGN PATENT DOCUMENTS

| | | | |
|---|---|---|---|
| 1260999 | 1/1972 | United Kingdom | 431/285 |

*Primary Examiner*—Carl D. Price

*Attorney, Agent, or Firm*—Evenson, McKeown, Edwards & Lenahan

[57] ABSTRACT

A burning method promotes rapid mixing and a stable flame in a burner to reduce $NO_x$ and CO emissions and to provide a smoother, quieter operation. The burner includes a primary fuel supply, a combustion air supply arranged to supply combustion air at low pressure, and a swirler for swirling the combustion air. When the primary fuel supply is gaseous fuel, the gaseous fuel is introduced radially into the swirling combustion air. A bluff body cone is arranged near the exit of the burner so as to be encountered by at least the swirling combustion air. An atomizer is arranged within the bluff body cone for atomizing liquid fuel when the primary fuel supply is a liquid fuel. Boost gas nozzles are arranged toroidily at the exit of the burner to supply and mix swirling boost gas for combustion with the combustion air when the gaseous fuel is the primary fuel supply, and mixer tabs are disposed around the periphery of the exit.

9 Claims, 5 Drawing Sheets

COMBINATION BURNER WITH BOOST GAS INJECTION

BACKGROUND AND SUMMARY OF THE INVENTION

The present invention relates to an improved burner and burner method used, for example, in the production of asphalt and, in particular, to a burner of greatly simplified construction which promotes more complete mixing of fuel and air and which utilizes a unique combination of primary and boost gas injection when the burner uses gaseous fuel.

A combination fuel aggregate dryer burner with a flame shaping swirl mechanism is disclosed in U.S. Pat. No. 4,559,009. This burner describes the use of internal recirculation to dispense with the need for ceramic tile with the use of internal recirculation. A blower supplies all of the combustion air for the burner. With the burning of oil (i.e., firing "on oil"), the burner atomizer assembly divides primary air into two flows and imparts a high degree of swirl to the inner primary air flow. A continuous sheet of oil is blast-atomized into this swirling air flow and is immediately broken up into droplets entrained within the flow. This highly swirling inner primary air is swirled out against the less swirled outer primary air with resultant shear atomization. The ignited swirling fuel oil/air mixture moves axially downstream and radially outwardly to decrease axial pressure and promote upstream recirculation of burning and unburned gases. When the burner is firing "on gas" (i.e. is burning only gas as the fuel) or a combination of oil and gas, the gas itself is not swirled but is mingled with outwardly swirling primary and secondary air flows.

Another type of fuel burner for drying aggregate in the making of asphalt and the like, and configured to burn liquid fuels or gas is shown in U.S. Pat. No. 4,298,337. This type of burner is known in the industry as a 30% burner because a blower provides about 30% of the combustion air. In order to obtain a large turndown ratio, it is necessary to provide compressed air to the atomizer to maintain a constant pressure even when oil flow and air from the turbo blower are operated at substantially reduced inputs. Instead of bluff body recirculation to achieve flame stabilization, the burner is described as utilizing internal recirculation through the use of atomized liquid fuel being mixed with air caused to swirl by a fixed swirl plate and a frusto-conical flame stabilization cone whose smaller end is spaced from the outlet of the burner cone to leave an annular inlet space. This arrangement is described as creating a low pressure zone near the center with a small, stable combustion volume. In the event gaseous fuel is used in lieu of oil, the gas also flows through the swirl plate blades to mix with the pressurized air from the blower as both the air and gas pass through the swirl plate.

Many other burners are also currently available or known for the combustion of gas, liquid fuel and combinations thereof. Typical burner constructions are shown in U.S. Pat. Nos. 3,163,203; 3,217,779; 3,391,981; 4,441,879; 4,451,230; 4,717,332; 4,859,173; and 5,009,174.

It is the goal of all these burners to provide a compact and efficient combustion burner, large turn-down ratio, flame stability, switchability between fuels, dependable operation and economical manufacture. The combustion burner shown, for example, in U.S. Pat. No. 3,163,203, swirls a liquid fuel/air mixture through vane slots, whereas, When the burner is operated on gaseous fuel (natural gas or propane), pressurized air is moved through the vaned slots into a combustion chamber and the gaseous fuel is passed through axially-disposed nozzles where it is then mixed with the swirling air.

Due to the unique problems associated with the production of asphalt, however, these burners and others constructed specifically for the asphalt production operation are unduly complicated in their constructional features and do not perform satisfactorily under all conditions. They also lack other advantages and features such as the ability to provide increased turn down at low fire and extremely stable and intense combustion throughout the burner's firing range in a simple way so as to reduce emissions without, for instance, the need for a compressed air source. At the same time, we have found that the known burners used in the asphalt industry do not satisfactorily enhance and protect the base of a flame recirculation zone or prevent the quenching of the base at that recirculation zone under oil flame.

Furthermore, we have found that the burners currently available do not overcome the foregoing disadvantages while also protecting and shaping the flame as at least the burner. In addition, whereas the prior burners used in asphalt production are known for use with refractory burner block or for use in a refractoryless application, these burners do not provide a satisfactory arrangement for use with and without refractory burning block depending on application temperature and thermal oxidation.

An object of the present invention is, therefore, to provide a new burner and burning method which provides more complete mixing of fuel and air in contrast with the known burners in which only a portion of the air, about one-third of the total volume, has the fuel injected thereinto.

Another object of the present invention is to provide more complete mixing of the fuel and air to obtain more rapid combustion for reducing the overall burner size and lowering CO emissions in a given combustion space before the flame leaves the combustion zone of the dryer. Rapid combustion is used here as combustion intensity defined as the BTU output per hour divided by the combustion space.

Yet a further object of the present invention is to provide a burner which uses swirl to encourage internal recirculation, to promote more rapid and complete combustion and to achieve NOX levels of lowest possible amount with very high combustion intensity and low $O_2$ levels.

Still a further object of the present invention is to provide a burner which produces a lower noise level and which will run smoother with less resonance in the duct work and drums due to a stable flame and less pulsing.

A further object of the present invention is to provide a burner which requires lower horsepower than previous burners of the same BTU capacity.

A still further object of the present invention is to provide a burner which can be adapted to industrial and high temperature applications where optional refractory burner tile is used for use in refractory lined combustion chambers such as incinerators.

Still another object of the present invention is the provision of a burner having a wider flame than previously obtained which is particularly advantageous for end users in the production of asphalt type large diameter drums.

These objects have been achieved in accordance with the present invention by the provision of a total air burner in which all the air passes through adjustable spin vanes, and the fuel is injected into the entire airstream rather than separating combustion air into two different streams with the fuel injected into only a portion thereof.

Another feature of the present invention is that it produces a wider flame than conventional asphalt burners with the same firing lengths at 50% and 100% firing. This has an advantage over narrower and longer flames of known burners for customers that have large diameter drums.

As a result of the foregoing, a new burner has been produced that is less costly than previously available burners due to its greatly simplified constructional principles while achieving complete combustion and flame stability. Because the burner in accordance with the present invention is inserted only slightly into the drum, it can run with a cooler drier breach plate. Furthermore, the burner in accordance with the present invention uses less horsepower than open fired burners of similar BTU capacity and can be used also in industrial and high temperature applications with refractory burner tile in refractory-lined combustion chambers such as incinerators.

BRIEF DESCRIPTION OF THE DRAWINGS

These and other features, objects, and advantages of the present invention will become more readily apparent from the following detailed description of a currently preferred embodiment of the present invention when taken in conjunction with the accompanying drawings wherein.

DETAILED DESCRIPTION OF THE DRAWINGS

Figure 1:
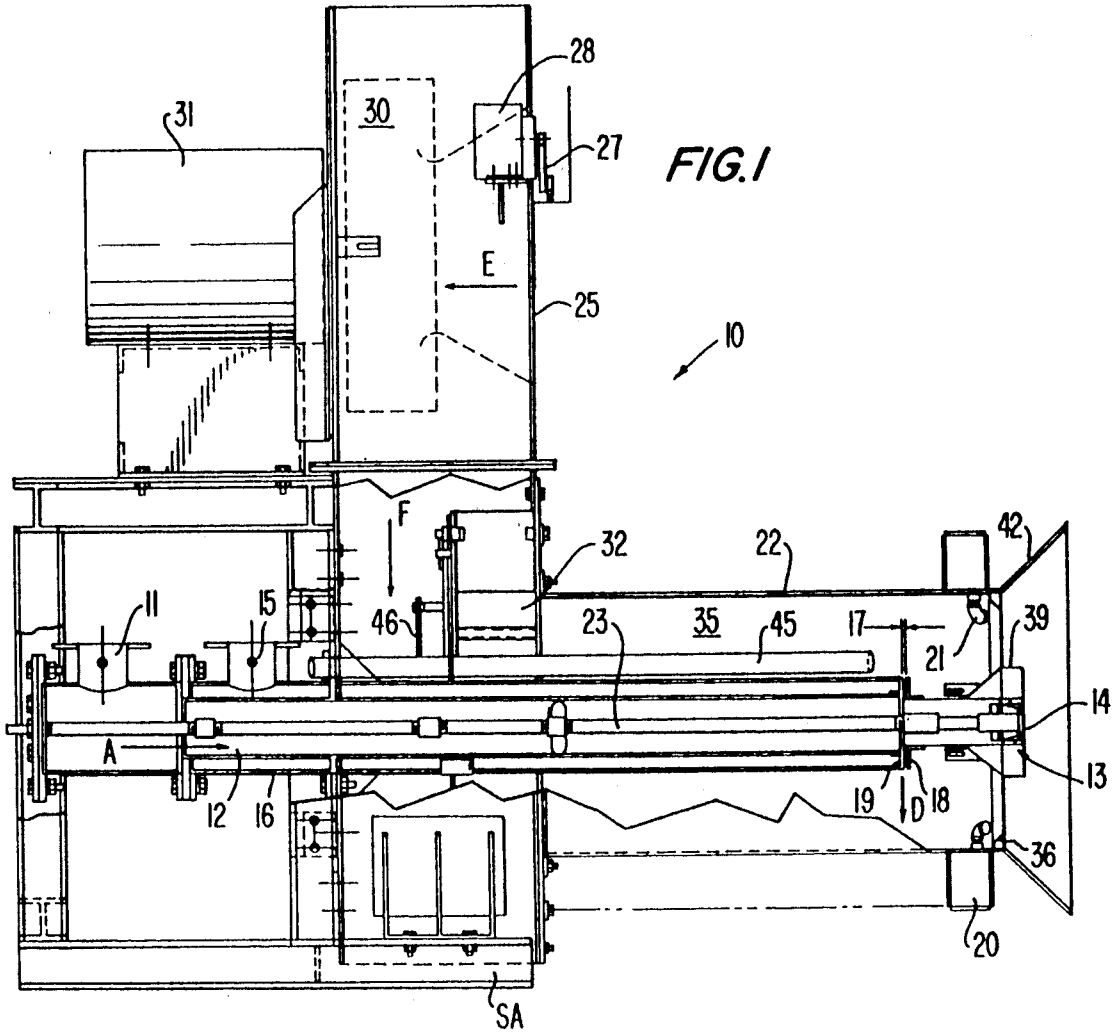
FIG. 1 is a partially cut-away side elevational view of the burner according to the present invention.
Figure 9:
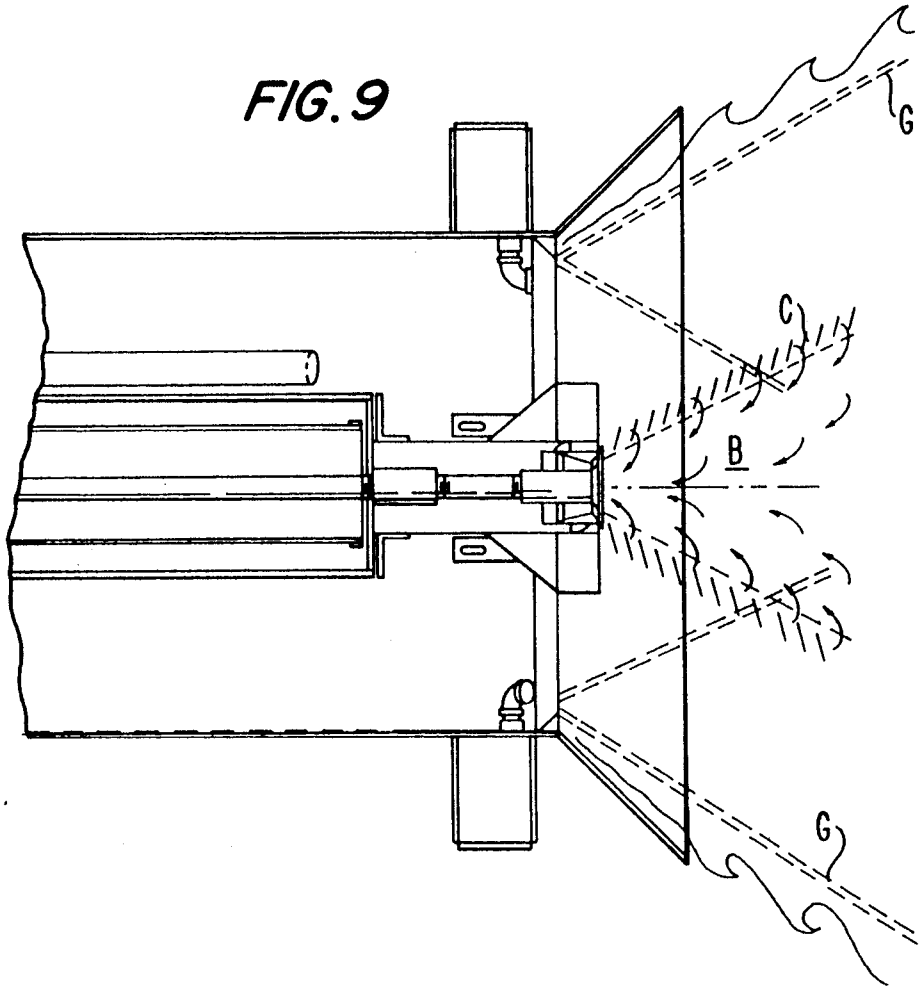
FIG. 9 is a schematic view of the exit of the burner shown in FIG. 1 schematically illustrating the liquid fuel cone when firing "on oil", the recirculation zone and the flame envelope when gas firing at about a mid spin setting with maximum BTU input.

Referring now to the drawings and, in particular, to FIG. 1, the burner utilizing the principle of the present invention is designated generally by the numeral 10 and is partially cut away to show those internal parts important to the invention. The burner 10 is arranged on a skid assembly SA and has an inlet 11 for admission of primary (atomizing) air. By way of example only, the pressure of the primary air is 36 osi. The primary air, whose direction is indicated by arrow A flows through a passage constituted by an assembly having a primary air tube 12 in the burner 10 and then through a conventional spin-baffle prefilming atomizer assembly designated generally by the numeral 13. The atomizer assembly 13 is of the known type currently sold by applicants' assignee, Hauck Manufacturing Company of Lebanon, Pa., and produces a subatmospheric primary flame recirculation zone immediately in front of a face 14 the atomizer 13 as shown by the arrows B in FIG. 9. This recirculation zone B, which can be seen when a flame is present, is established even with gaseous fuels because of the strong spin and baffle effect of the atomizer 13 on the primary (atomizing) air A.

Figure 3:
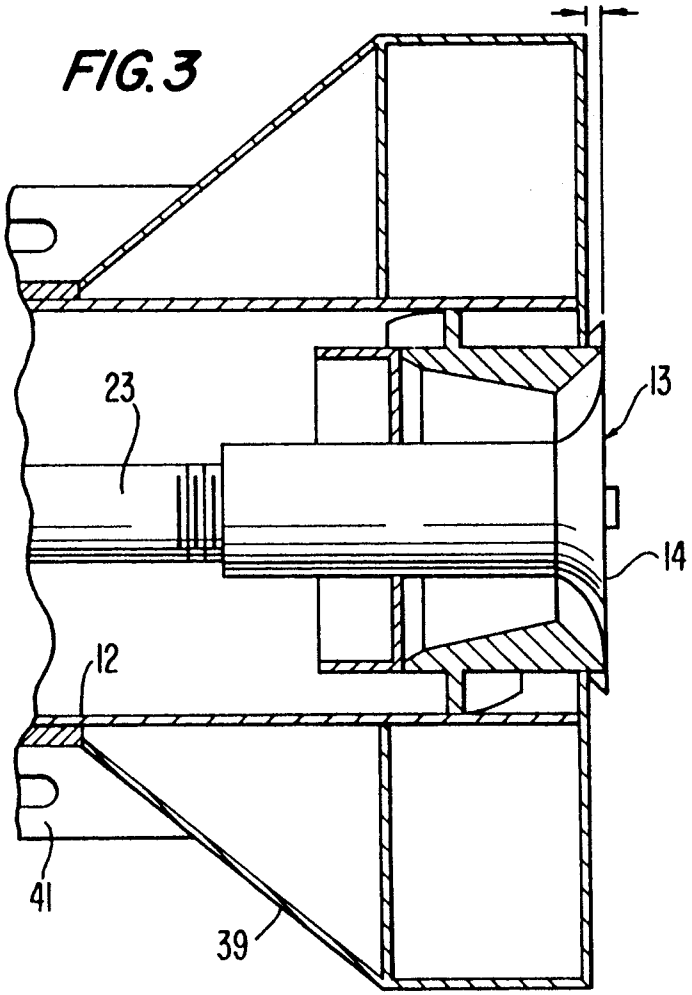
FIG. 3 is an isolated, enlarged view of the liquid fuel atomizer and primary air cone arrangement shown in FIG. 1.

In the event a fuel other than gas, e.g. oil or liquid propane, is more readily available, the burner 10 can be constructed to burn that fuel. In the illustrated embodiment, the burner 10 is configured for burning oil. Specifically, an oil tube 23 is arranged centrally in the primary air tube 12. The oil passing through the tube 23 is atomized by the atomizer unit 13 (FIG. 3) in a known manner as the oil exits the burner 10. The oil spray designated by the hatched cone C (FIG. 9) leaving the atomizer 13 begins to burn in the primary flame recirculation zone B in a cone-shaped flame (shown in dot-dash lines) that burns within and outside of the cone-shaped spray C exiting the atomizer 13.

For burning "on gas", the burner 10 is provided with a primary gas inlet 15 through which the gaseous fuel is flowed through an assembly having a gas tube 16 and discharges into a passage 17 defined by a splash plate 18 and by the end 19 of the gas tube 16. By way of illustration, the width of the passage 17, as viewed in an axial direction of the burner 10, can be on the order of $\frac{1}{4}$–$\frac{3}{8}$ inch. This distance can be varied, however, by loosening conventional set screws axially fixing the splash plate of a reduced portion of the gas tube 16 to provide the appropriate pressure drop for achieving optimum flame stability and the like. The passage 17 defined by the splash plate 18 achieves the pressure drop by directing the primary gas exiting from the gas tube 16 radially outwardly (arrow D) in a 360° manner into the main air flow.

Figure 6:
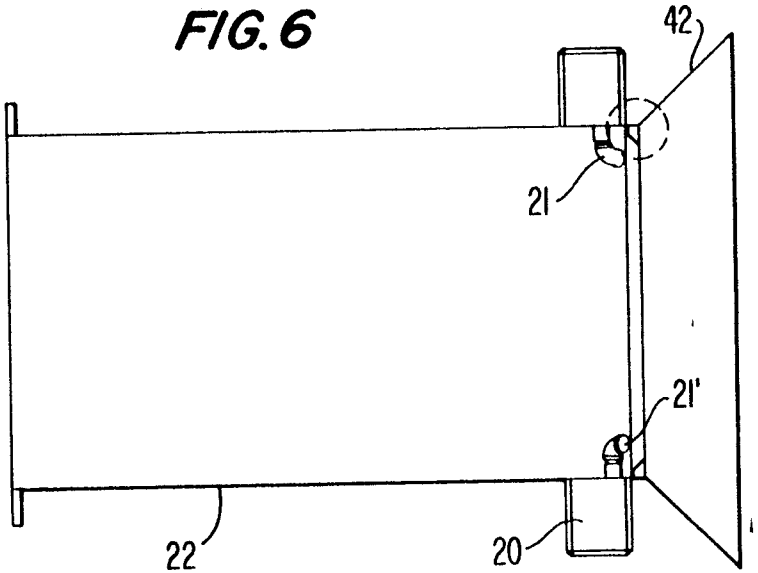

A boost gas inlet (not shown) allows the entry of boost gas to a boost gas inlet plate or manifold 20 near the discharge end of the burner 10. The boost gas then flows through multiple boost gas discharge nozzles 21 disposed around the circumference of the burner flame tube 22 shown in more detail in FIGS. 6–8. The nozzles 21 (twenty-four being shown in FIG. 7) are arranged around the circumference of the flame tube shell of the flame tube 22 at an annular spacing of two times $\alpha$ (15° in the illustrated embodiment) therebetween with their exits 21 in a toroidal manner to inject gas therefrom in a swirling pattern which is essential to burner stability at high firing rates. The nozzles 21 can be comprised of, for example, a coupling, an elbow and a nipple, although other constructions of the nozzle 21 could be used without departing from the scope of the present invention.

When the burner 10 is "on gas" at low firing rates, the gas fuel supply is provided only through the primary gas tube 16. As the firing rate increases, however, a boost gas inlet valve of known construction (not shown) begins to open to allow gas to flow through a manifold 24 to the inlet plate 20 and through the nozzles 21. At the maximum firing rate, the ratio of the primary gas to boost gas is in a range of about 50:50 to 25:75.

This simple arrangement provides for increased turndown at low firing rates where a greater amount of primary gas is used while maintaining extremely stable and intense combustion over the entire firing range of the burner 10, resulting in substantially lower $NO_x$ levels and a smoother running burner.

Main combustion air enters the burner 10 through a multiple-blade pre-swirl inlet 25 in housing 26. A variable damper 27 arrangement is provided in the inlet 25 and is controlled in a known manner by a damper motor 28 held on the housing 26 by a bracket assembly 29. The main combustion air indicated by arrow E is caused to move into the housing 26 by a impeller 30 driven by a motor 31 and sized to produce a pressure of about 0.5 psig. The main combustion air then enters the burner body, as indicated by arrow F, where it flows through spin vane assembly 32 which is adjustable through a lever 46 located on the outside of the burner housing to obtain high spin rates even at reduced air flows because the spin vanes serve to reduce the area at spin settings over about 50°. At lower air flows, high spin rates, and thus high combustion intensities, can also be achieved since the air pressure drop across the vanes is maximized at less than maximum flow. The main combustion air then passes from the spin vane assembly 32 into the burner throat area 35. From the throat area 35, the main combustion air then passes the primary gas injection area at the center of the burner 10 and the boost gas injection nozzles 21.

Figure 7:
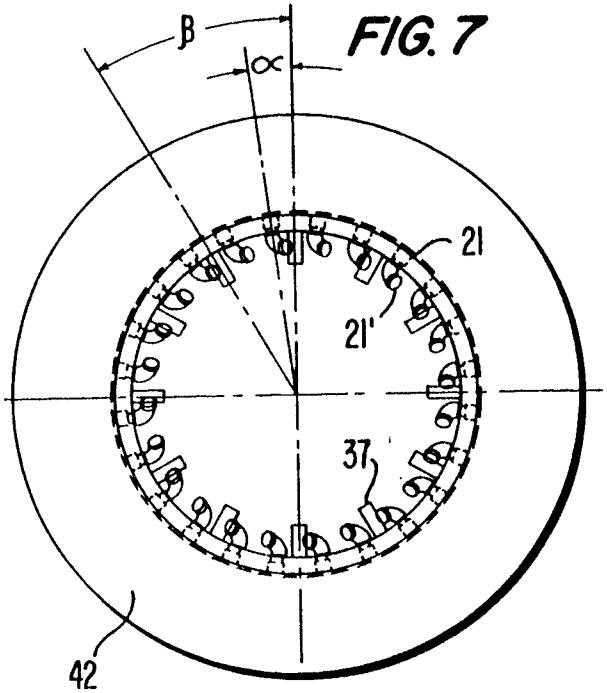
FIGS. 6 and 7 are, respectively, isolated side and end views of the flame tube assembly shown in FIG. 1.
Figure 8:
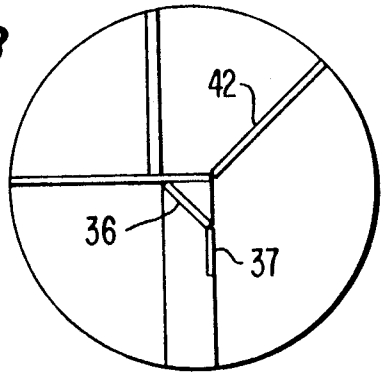
FIG. 8 is an isolated, enlarged view of the dot-dash circle in FIG. 6 of the bluff body boost gas flame holder and mixer tabs attached around the periphery of the pinch diverter cone of the flame tube assembly shown in FIGS. 6 and 7.

A pinch diverter cone 36 (FIG. 8) is provided at the end of the burner flame tube 22 to increase and concentrate the spin component of the main combustion air as it passes thereover. When the burner 10 is "on oil", the cone 36 also serves to drive oil overspray from the atomizer assembly 13 back into the flame. Bluff body boost gas flame holder and mixer tabs 37 can be attached to the pinch diverter cone 36, as seen in FIGS. 7 and 8, to allow the boost gas, when the burner 10 is "on gas" and is operating at higher firing rates, to begin burning, as it leaves the burner throat area, in order to obtain maximum flame intensity with minimum combustion noise due to the flame stability. In the presently contemplated embodiment, twelve such tabs 37 are provided around the periphery of the diverter cone 36 at a spacing $\beta$ of 30°. Of course, it should be readily apparent that the number, size and shape of tabs 37 may be varied without departing from the scope of the present invention.

Figure 5:
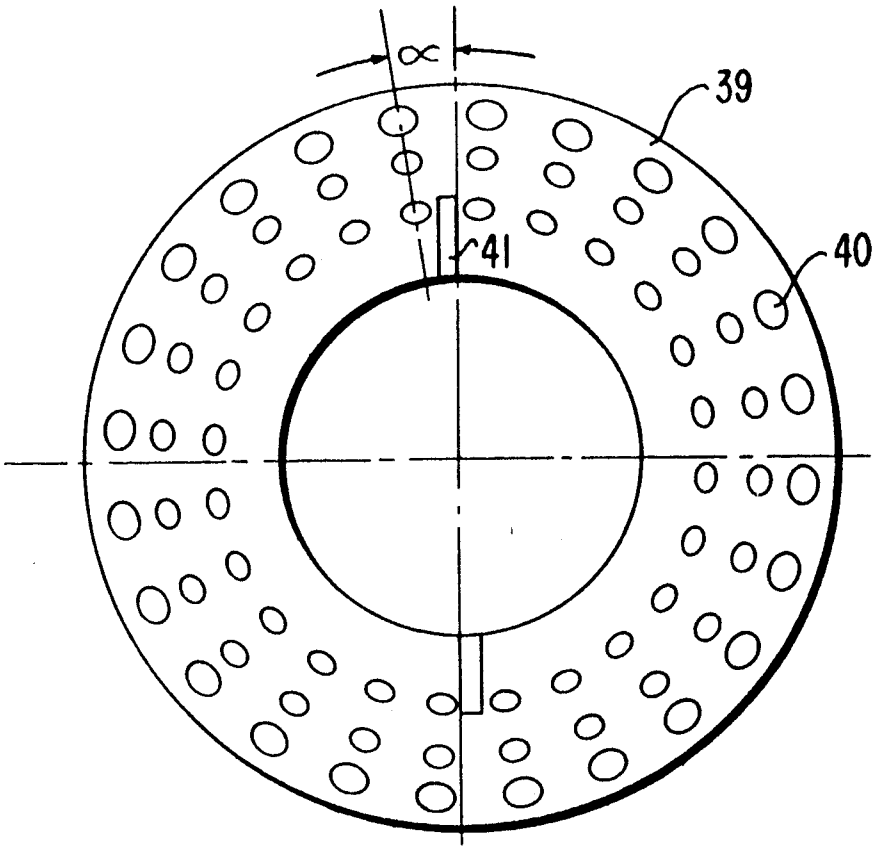
FIGS. 4 and 5 are, respectively, isolated side and end views of the primary air cone assembly shown in FIGS. 1 and 3.
Figure 4:
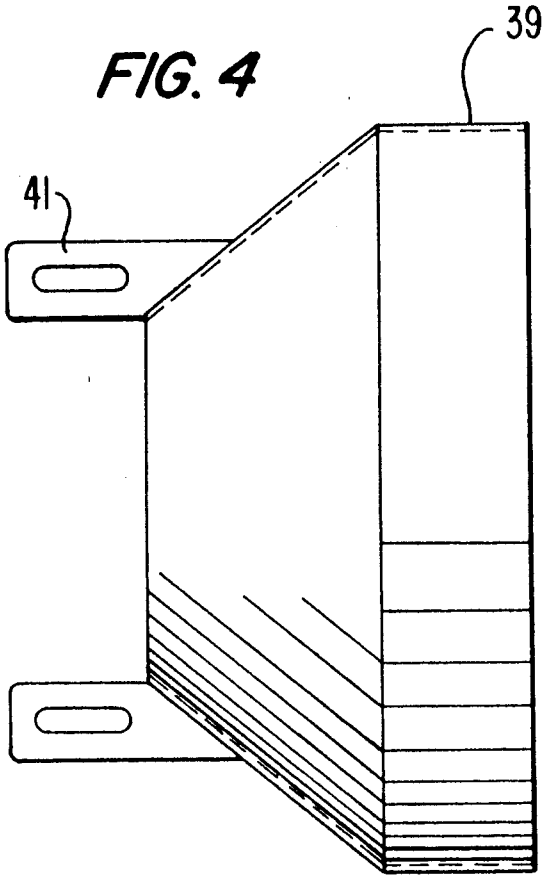

A primary air bluff body cone 39, as shown in detail in FIGS. 4 and 5, is arranged in the center of the burner 10, at the end of the primary air tube 12 in the area of the atomizer assembly 13 so that the swirling main combustion air encounters the cone 39 to enhance and protect the base of the flame recirculation zone through the generally well known "bluff body" recirculation principle, and also to prevent quenching of the base of the oil flame. The cone 39 has holes or perforations 40 over its diverging conical surface. The perforations can have an annular spacing $\alpha$ of, for example, 9½°. Again, it will be appreciated by one of ordinary skill in the art that the number, size and spacing of the holes 40 can vary depending upon burner applications and fuels without departing from the scope of the present invention. Axially opposed adjusting brackets 41 are arranged at the rear of the cone 39 so mount the latter for slight axial adjustment along the length of the flame tube 12. A main body cone 42 at the end of the flame tube 22 shapes the flame, as shown by the dotted lines G in FIG. 9, and protects the latter from falling aggregate and the like as it leaves the burner 10. Even for high temperature industrial and thermal oxidizer applications using refractory burner block, the angle of the main body cone 42 will be present in the refractory block.

Figure 2:
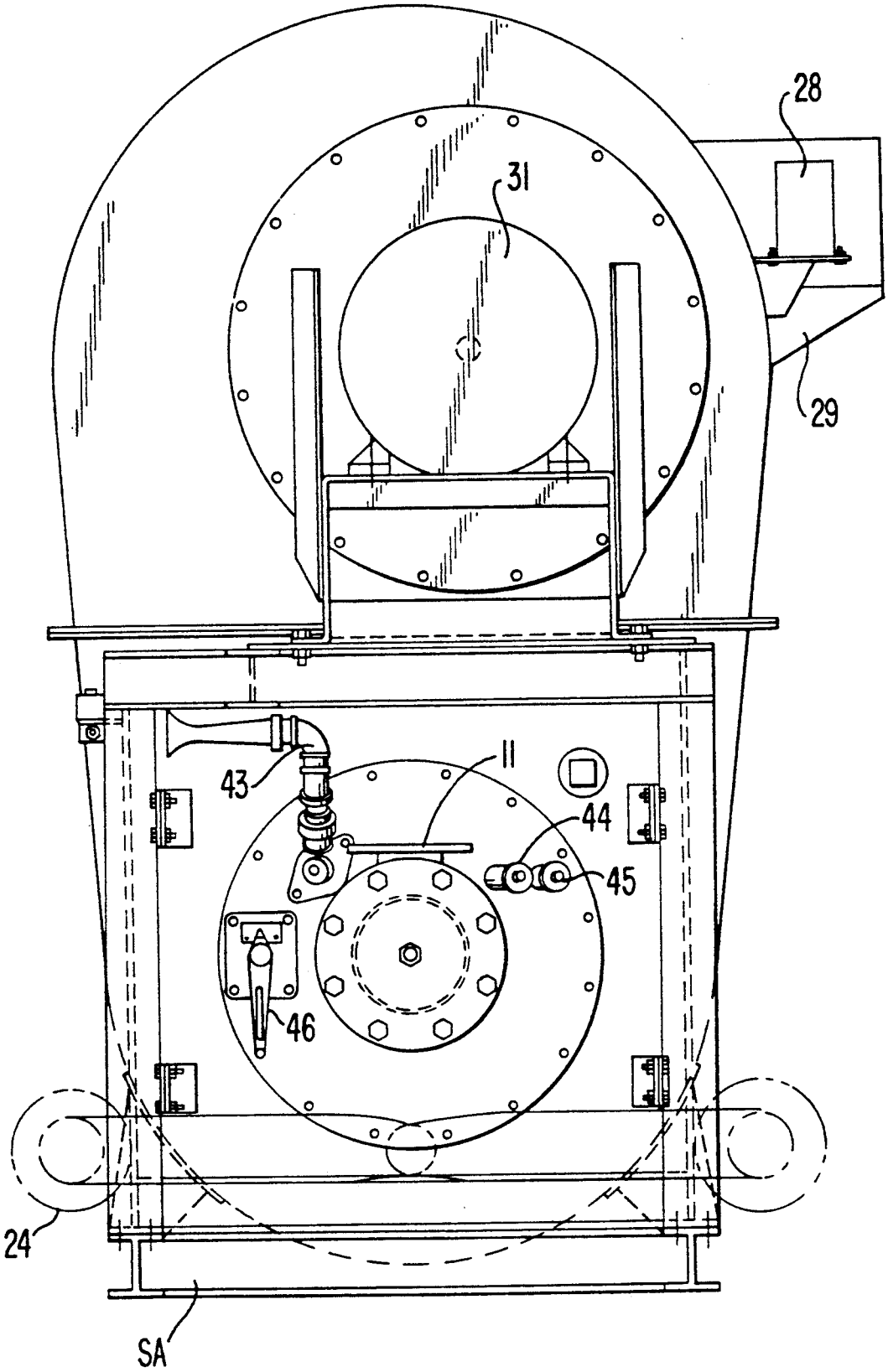
FIG. 2 is an end view of the burner shown in FIG. 1.

The burner 10 is ignited with a spark ignited pilot 43 (FIG. 2) in a standard manner. Likewise, the pilot 43 is monitored by a conventional UV flame scanner 44, whereas the main flame is monitored by a separate standard UV flame scanner 45. The burner 10 can also be installed in a conventional aggregate dryer via a standard-type mounting plate (not shown) integrally arranged at a appropriate place on the wall forming the flame tube 22.

By way of specific example, combustion intensities in a burner constructed as described above, at full spin, were around 250,000 BTU/ft$^2$ with CO readings of a magnitude associated with burners having much lower combustion intensities, e.g. 175,000 BTU/ft$^2$. Combustion intensity is defined here BTU output per hour divided by the combustion space. Such low CO readings are indicative of complete combustion in the combustion zone. Noise reduction on the order of 12 to 14 dba have been achieved while the burner runs smoother with lower combustion sound, and less vibration in the duct work and drums to reduce metal fatigue. Low $NO_x$ levels were also obtained at the high combustion intensities and low $O_2$ levels. Moreover, a 100 million BTU/hr capacity burner built according to the present invention requires only a main fan having somewhere between 50 and 75 horsepower, and a 15 horsepower atomizer fan in contrast to previous burners which required a total horsepower, for a similar capacity, of around 125 horsepower. The burner produces a wider flame which is particularly desirable when the burner is used with larger diameter drums requiring a wider flame.

Tables I and II below illustrate other scaling and design criteria of the burner over a range of capacities from 25 million BTU/hr to 170 million BTU/hr with the understanding that individual criteria may need to be varied to optimize actual performance as will be apparent to those skilled in the art.

TABLE I

| Capacity MM btu/hr | Main Air SCFH includes 20% XSA | Main Air SCFM includes 20% XSA | Nat. Gas CFH | Oil GPH | Atomizing Air CFH | % of atomizing air to total air | Velocity Atomizing ft/sec | velocity primary gas (25% of total flow) ft/sec | neck veloc at ft/sec | air disch veloc ft/sec |
|---|---|---|---|---|---|---|---|---|---|---|
| 25 | 300000 | 5000 | 25000 | 179 | 19920 | 6.2 | 103 | 24 | 89 | 161 |
| 50 | 600000 | 10000 | 50000 | 357 | 46440 | 7.2 | 98 | 19 | 103 | 162 |
| 75 | 900000 | 15000 | 75000 | 536 | 46440 | 4.9 | 98 | 29 | 94 | 127 |
| 100 | 1200000 | 20000 | 100000 | 714 | 46440 | 3.7 | 98 | 39 | 125 | 169 |
| 130 | 1560000 | 26000 | 130000 | 929 | 66000 | 4.1 | 96 | 27 | 127 | 165 |
| 170 | 2040000 | 34000 | 170000 | 1214 | 66000 | 3.1 | 96 | 35 | 125 | 170 |

TABLE II

| Capacity MM btu/hr | velocity through vane at discharge ft/sec | velocity through vane at entrance ft/sec | veloc. @ vane plate | inlet aspect ratio of vane entrance | ratio of vane arc length to pivit length | distance from vane pivot point to top of vane | qty. boost gas elbows | arc length between gas boost elbows | outside gas nozzle velocity ft/sec | static pressure of main blower at full capacity |
|---|---|---|---|---|---|---|---|---|---|---|
| 25 | 88 | 57 | 75 | 0.75 | 1.07352 | 1 | 12 | 3.79658 | 172 | 16.5 |
| 50 | 71 | 47 | 76 | 0.59 | 1.08006 | 1 | 16 | 3.82931 | 190 | 15 |
| 75 | 68 | 43 | 72 | 0.57 | 0.89023 | 2 | 24 | 3.142 | 151 | 13.5 |
| 100 | 91 | 57 | 95 | 0.57 | 0.89023 | 2 | 24 | 3.142 | 201 | 17 |
| 130 | 85 | 54 | 90 | 0.56 | 0.86187 | 2 | 28 | 3.08589 | 224 | 15.5 |
| 170 | 88 | 58 | 94 | 0.58 | 0.93824 | 2 | 28 | 3.47864 | 221 | 22 |

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A burner for promoting rapid mixing and a stable flame comprising a body in which are contained a primary fuel supply, a combustion air supply arranged to supply combustion air at low pressure, means for swirling the combustion air, means for introducing, when the primary fuel supply is a gaseous fuel used, the gaseous fuel radially into the swirling combustion air, a bluff body cone arranged near an exit of the burner body so as to be encountered by at least the swirling combustion air, an atomizer arranged within the bluff body cone for atomizing liquid fuel when the primary fuel supply is a liquid fuel, boost gas nozzles arranged toroidily at the exit of the burner body to supply and mix swirling boost gas for combustion with the combustion air when the gaseous fuel is the primary fuel supply, and mixer tabs disposed around the periphery of the exit.

2. The burner according to claim 1, wherein a diverging cone is operatively arranged at the exit of the burner body.

3. The burner according to claim 1, wherein the bluff body cone is provided with a plurality of apertures arranged around a diverging surface thereof.

4. The burner according to claim 1, wherein the bluff body cone is adjustable in an axial direction of the burner.

5. The burner according to claim 1, wherein the means for swirling the combustion air is adjustable to vary an angle of blades over which the combustion air passes to shape the flame and promote complete combustion.

6. The burner according to claim 1, wherein the gaseous fuel supply means and boost gas nozzle are configured to provide a ratio of primary gas and boost gas, respectively, in a range from about 50:50 to 25:75.

7. A method for promoting rapid mixing of fuel and air and for obtaining a stable combustion flame in a burner, comprising:

swirling combustion air;

at least one of the steps of radially introducing gaseous fueled into the swirling combustion air and of atomizing liquid fuel;

providing bluff body recirculation of at least the swirling combustion air at the exit of the burner; and supplying, depending upon burner firing rate, a predetermined amount of swirling boost gas into the region of the bluff body recirculation when the step of radially introducing gaseous fuel into the swirling combustion air is utilized.

8. The method according to claim 7, wherein the step of supplying the swirling boost gas includes increasing and concentrating the swirling component of the swirling combustion air.

9. The method according to claim 7, wherein the step of atomizing liquid fuel includes driving oil overspray into the flame.

* * * * *